US008302331B2

(12) United States Patent
Faber et al.

(10) Patent No.: US 8,302,331 B2
(45) Date of Patent: Nov. 6, 2012

(54) HARNESS HINGE MEMBER ATTACHMENT FOR SNOWSHOE

(75) Inventors: Guy Faber, Quebec (CA); Richard Faber, Quebec (CA)

(73) Assignee: Faber & Co., Inc., Quebec, Quebec (CA)

( * ) Notice: Subject to any disclaimer, the term of this patent is extended or adjusted under 35 U.S.C. 154(b) by 511 days.

(21) Appl. No.: 12/691,152

(22) Filed: Jan. 21, 2010

(65) Prior Publication Data

US 2011/0173845 A1 Jul. 21, 2011

(51) Int. Cl.
*A63C 13/00* (2006.01)

(52) U.S. Cl. ..... 36/125; 36/124

(58) Field of Classification Search ..... 36/122–125
See application file for complete search history.

(56) References Cited

U.S. PATENT DOCUMENTS

| | | | | |
|---|---|---|---|---|
| 3,802,100 | A | 4/1974 | Prater | |
| 4,720,928 | A | 1/1988 | Faber et al. | |
| 5,517,772 | A | 5/1996 | Anderson | |
| 5,531,035 | A | 7/1996 | Forrest | |
| 5,542,197 | A | 8/1996 | Vincent | |
| 6,003,249 | A | 12/1999 | Watson | |
| 6,112,436 | A * | 9/2000 | Quellais | 36/124 |
| 6,163,984 | A | 12/2000 | Faber et al. | |
| 6,233,849 | B1 | 5/2001 | Gallay et al. | |
| 6,564,478 | B1 | 5/2003 | Wing et al. | |
| 6,725,576 | B2 | 4/2004 | Emerson et al. | |
| 6,898,874 | B2 | 5/2005 | Emerson et al. | |
| 7,194,825 | B2 | 3/2007 | Faber et al. | |
| 7,793,439 | B2 * | 9/2010 | Chartrand et al. | 36/124 |
| 2008/0141564 | A1 * | 6/2008 | Matthews et al. | 36/124 |
| 2008/0263902 | A1 * | 10/2008 | Chartrand et al. | 36/122 |
| 2009/0172974 | A1 | 7/2009 | Faber et al. | |
| 2010/0307029 | A1 * | 12/2010 | Chartrand et al. | 36/124 |

FOREIGN PATENT DOCUMENTS

| | | |
|---|---|---|
| CA | 2528734 | 9/2006 |
| CA | 2672219 | 6/2008 |
| CA | 2617453 | 7/2009 |

* cited by examiner

*Primary Examiner* — Ted Kavanaugh
(74) *Attorney, Agent, or Firm* — Fraser Clemens Martin & Miller LLC; J. Douglas Miller

(57) ABSTRACT

The snowshoe has a hinge member for mounting a harness to the snowshoe's frame, the hinge member having a rigid pivot rod for extending between first and second side segments of the frame and comprising opposite first and second end portions, the pivot rod for pivotally receiving the harness. The hinge member also includes a first rigid rod attachment mount having a first frame socket for pivotal attachment to the frame first side segment so as to be pivotable about the frame first side segment, and a first rod socket wherein the rigid pivot rod first end portion is pivotally mounted, the first rod socket being spaced apart from the first frame socket so as to allow the pivot rod to pivot about an axis which is generally parallel to and spaced from the first frame socket. The hinge member further includes a second rigid rod attachment mount having a second frame socket for pivotal attachment to the frame second side segment so as to be pivotable about the frame second side segment, and a second rod socket wherein the rigid pivot rod second end portion is pivotally mounted, the second rod socket being spaced apart from the second frame socket so as to allow the pivot rod to pivot about an axis which is generally parallel to and spaced from the second frame socket.

17 Claims, 8 Drawing Sheets

Fig.5
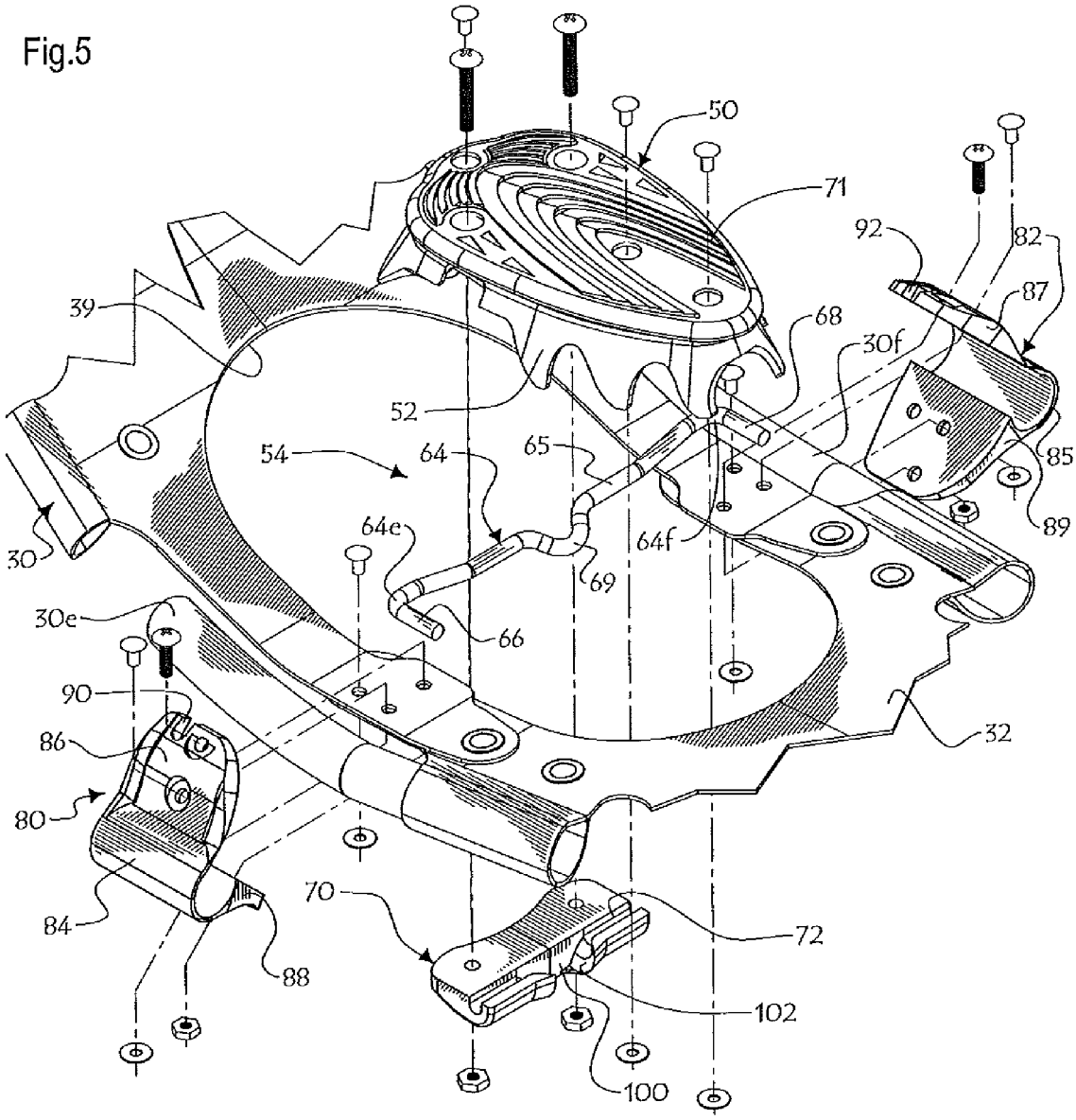
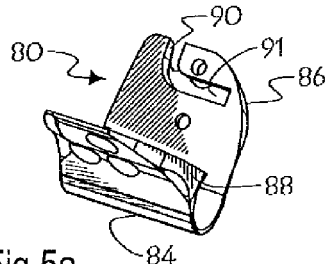
Fig.5a

HARNESS HINGE MEMBER ATTACHMENT FOR SNOWSHOE

FIELD OF THE INVENTION

The present invention relates to snowshoes and more particularly to the hinge member that pivotally attaches the harness to the frame of the snowshoe.

BACKGROUND OF THE INVENTION

Snowshoes have a frame that carries a decking. The frame is typically oblong and either in the form of an opened loop (e.g. having side segments and a front segment but no rear segment) or a closed loop (i.e. the frame peripherally encloses the decking and thus also includes a rear segment). A harness or binding allows the snowshoe to be releasably attached to the user's foot and a hinge member allows the harness to be pivotally mounted to the frame. The hinge member will allow the pivotal movement of the harnessed foot relative to the frame and decking during gait, and more particularly the harness will rock back and forth reciprocatingly through a toe hole made in the decking.

Hinge members come in different types. Some of them allow the harness to be mounted directly to the decking, while others instead allow the harness to be mounted to the frame. In the latter case, it is known to provide a pivot rod that extends transversely between the frame side segments and is fixedly attached thereto, with the harness being pivotally mounted to the pivot rod. With the pivot rod attached directly to the frame, any vibration or impact on the frame is transmitted through the rigid frame and pivot rod directly to the user's foot, making for an uncomfortable snowshoeing experience.

One known alternative to alleviate this problem is to attach the pivot rod to the frame by means of flexible leather or plastic straps in which case however the frame may undesirably collapse inwardly during gait. Indeed, as the user's load is applied on the harness and consequently on the pivot rod, the latter will be forced downwardly, effectively pulling on the flexible straps that attach it to the frame side segments. As a consequence, the frame side segments will be pulled inwardly, effectively undesirably deforming the frame during gait. This is also a detriment to a pleasant snowshoeing experience. One way to circumvent this problem is to reinforce the frame itself, for example by having a thicker frame, in which case the weight of the snowshoe undesirably increases.

Another problem with flexible straps linking the pivot rod to the frame is that it decreases the lateral control of the snowshoe. Indeed, when the user wishes to turn or sidestep, he will apply sideward pressure on his harness/pivot rod assembly. Since the latter is not rigidly linked to the frame through its flexible straps, there will be a lag in the movement of the frame/decking of the snowshoe with regards to the actual sideward movement of the foot. This is of course is undesirable.

Another problem with known hinge members relates to the allowable range of pivotal displacement of the snowshoe when it is worn. Indeed, if the attachment of the harness to the snowshoe allows a full range of pivotal displacement of one relative to the other, then when the user lifts his harnessed foot over ground, for example to walk over an obstacle such as a tree limb, the snowshoe rear end tail will hang towards the ground under it own weight, possibly getting caught up in the tree limb and generally hindering the user while he tries to step over the obstacle; concurrently, the front end of the snowshoe will pivot upwardly, possibly undesirably contacting the user's shinbone. One way to obviate this problem is to include a pivotal limiter on the snowshoe, However, known pivotal limiters are often inappropriate or ineffective; and some allow snow and ice to clog the limiter.

SUMMARY OF THE INVENTION

The present invention relates to a hinge member for mounting a harness to a frame of a snowshoe, comprising:

a rigid pivot rod for extending between frame first and second side segments and comprising opposite first and second end portions, said pivot rod for pivotally mounting the harness relative to the frame;

a first rigid rod attachment mount having a first frame socket for pivotal attachment to the frame first side segment so as to be pivotable about the frame first side segment, and a first rod socket wherein said rigid pivot rod first end portion is pivotally mounted, said first rod socket being spaced apart from said first frame socket so as to allow said pivot rod to pivot about an axis which is generally parallel to and spaced from said first frame socket; and a second rigid rod attachment mount having a second frame socket for pivotal attachment to the frame second side segment so as to be pivotable about the frame second side segment, and a second rod socket wherein said rigid pivot rod second end portion is pivotally mounted, said second rod socket being spaced apart from said second frame socket so as to allow said pivot rod to pivot about an axis which is generally parallel to and spaced from said second frame socket.

The present invention also relates to a snowshoe defining opposite top and bottom surfaces, opposite front and rear ends, opposite first and second sides, a longitudinal axis between said front and read ends, a transversal axis between said first and second sides and a vertical axis between said top and bottom surfaces, said snowshoe comprising:

a rigid frame defining first and second spaced-apart elongated side segments extending generally longitudinally along said snowshoe first and second sides, and a front segment linking said first and second side segments at said snowshoe front end;

a decking carried by said frame between said first and second side segments;

a rigid pivot rod extending generally parallel to said transversal axis and comprising opposite first and second end portions;

a harness for releasable attachment to a user's foot, said harness being pivotally mounted relative to said frame by means of said pivot rod so as to be pivotable generally about an axis which is generally parallel to said transversal axis;

a first rigid rod attachment mount comprising a first frame socket pivotally mounted to said frame first side segment so as to be pivotable about said frame first side segment, and a first rod socket within which said rigid pivot rod first end portion is pivotally mounted, with said first frame socket being spaced apart from said first rod socket so as to allow said pivot rod to pivot about an axis which is generally parallel to and spaced from said frame first side segment; and a second rigid rod attachment mount comprising a second frame socket pivotally mounted to said frame second side segment so as to be pivotable about said frame second side segment, and a second rod socket within which said rigid pivot rod second end portion is pivotally mounted, with said second frame socket being spaced apart from said second rod socket so as to allow said pivot rod to pivot about an axis which is generally parallel to and spaced from said frame second side segment;

wherein said rigid pivot rod and rigid first and second rod attachment mounts cooperate to maintain said first and second frame side segments spaced apart with respect to one another for providing an enhanced rigidity to said snowshoe while allowing said harness to move along said vertical axis and to roll generally about said longitudinal axis for providing a suspension effect to said snowshoe.

In one embodiment, said harness comprises a cradle for receiving the user's foot, said cradle pivotally engaging said pivot rod, said cradle comprising an elongated cradle socket for said pivot rod in which said pivot rod is partly enclosed by said cradle.

In one embodiment, said cradle comprises a cradle plate which is located over said pivot rod along said vertical axis.

In one embodiment, said first and second rigid rod attachment mounts are further attached to said decking.

In one embodiment, said pivot rod has a rest position and said snowshoe defines biasing means that continuously force said pivot rod towards said rest position along said vertical axis.

In one embodiment, said pivot rod is allowed to move vertically down and away from said rest position along said vertical axis, but not up and away from said rest position.

In one embodiment, said pivot rod is arched towards said bottom surface of said snowshoe.

In one embodiment, said snowshoe comprises means for limiting the pivotal movement of said harness about said rod within a determined angular range.

In one embodiment, the snowshoe further comprises means for selectively adjusting the value of said determined angular range.

In one embodiment, said harness comprises a cradle for receiving the user's foot and pivotally engaging said pivot rod, said pivot rod comprising a first pivot limiter and said cradle comprising a second pivot limiter complementary to said first pivot limiter whereby said first and second pivot limiter can engage one another to allow the pivotal displacement of said cradle about said pivot rod to be limited to a determined angular range.

In one embodiment, said first pivot limiter is an elbow extending radially away from said pivot rod and said second pivot limiter is an abutment shoulder formed in said cradle whereby said cradle may not pivot beyond a position where said elbow abuts against said abutment shoulder.

In one embodiment, the snowshoe further comprises means for adjusting the position of said abutment shoulder whereby the value of said determined angular range may be selectively adjusted.

In one embodiment, said means for adjusting the position of said abutment shoulder include an adjustment screw threadingly engaging said cradle with one end of said screw capable of acting as said abutment shoulder, said screw being selectively movable to allow adjustment of the position of said abutment shoulder.

In one embodiment, said means for adjusting the position of said abutment shoulder include a shoulder support mounted to said cradle and carrying at least two different shoulder pads each corresponding to different limit angular values of said determined angular range.

In one embodiment, said elbow further engages said cradle to prevent said cradle is from moving in a direction generally parallel to said transversal axis along said pivot rod.

In one embodiment, said frame further comprises a rear segment linking said first and second side segments at said rear end of said snowshoe, whereby said frame peripherally encloses said decking.

DESCRIPTION OF THE DRAWINGS

In the annexed drawings

FIG. 5 is an exploded perspective view of the elements shown in FIG. 3 with the rod attachment mounts being shown in an artificial spread-apart position;

FIG. 5*a* is a perspective view of the rod attachment mount from showing more particularly the rod socket in the top arm thereof;

DETAILED DESCRIPTION OF THE EMBODIMENTS

Figure 1:
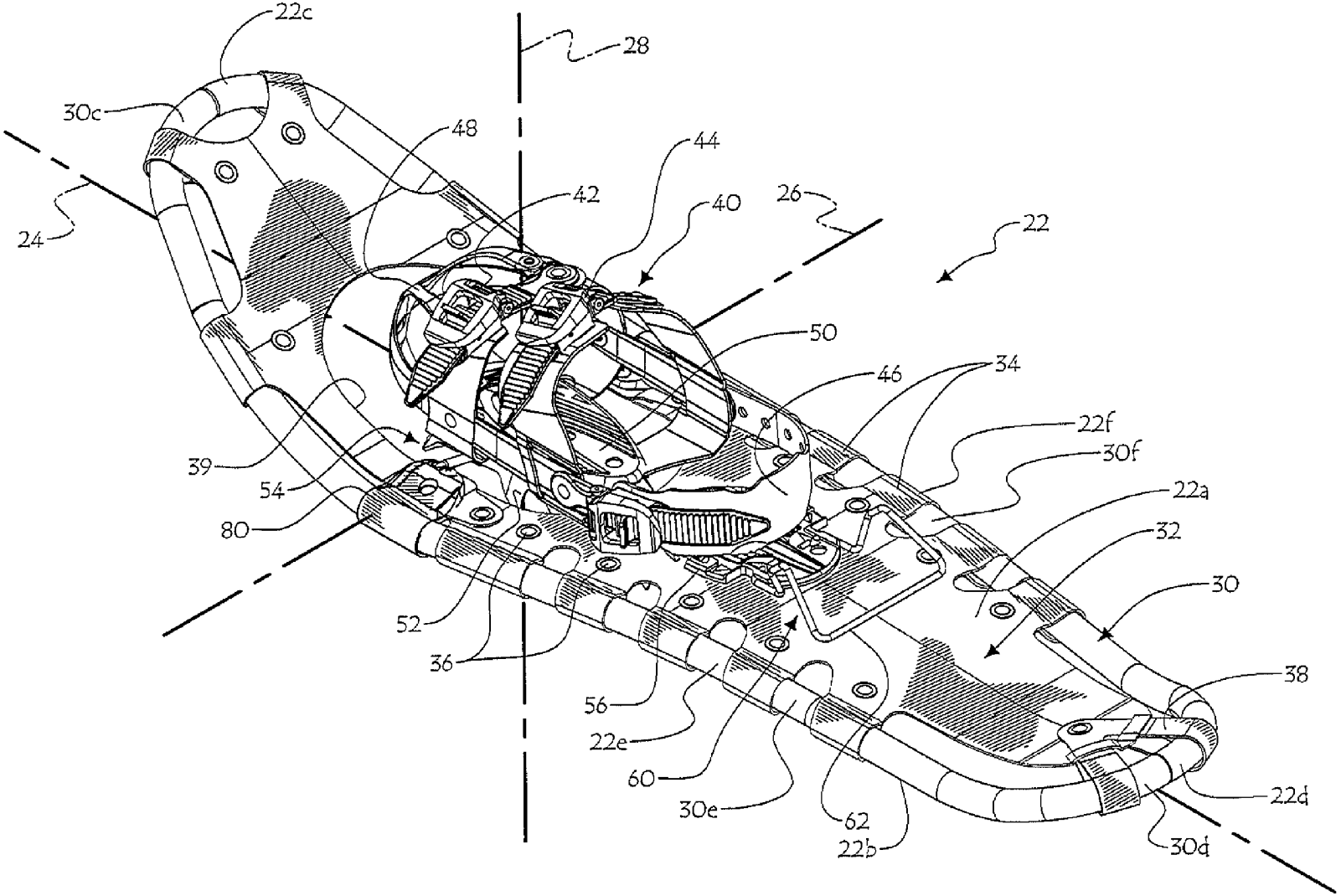
FIG. 1 is a perspective view, taken from the rear, top and left, of a snowshoe according to the present invention, with the harness in a first limit position and the heel lifter in its stowed position.
Figure 2:
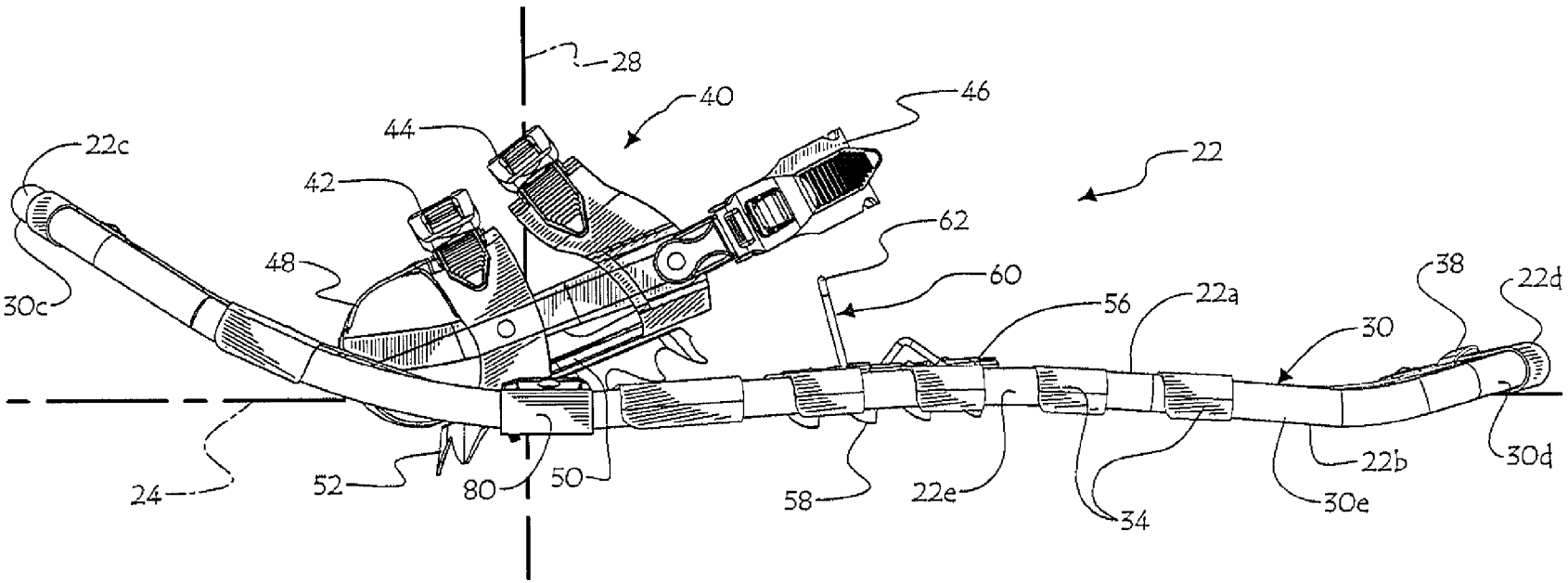
FIG. 2 is a side elevation of the snowshoe of FIG. 1, with the harness pivoted partly through the toe hole away from its first limit position and the heel lifter being in its operative position.
Figure 6:
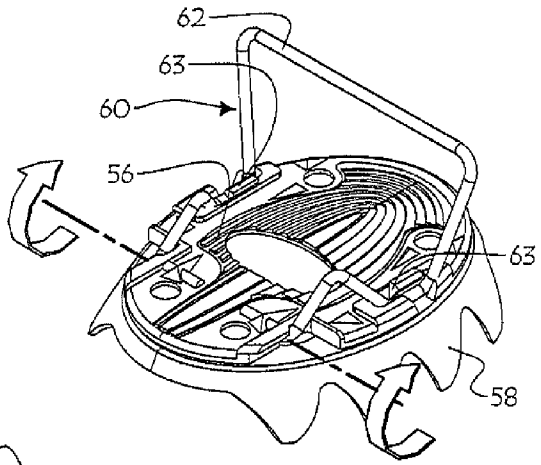
FIG. 6, located on the same page as FIG. 3, is an enlarged perspective view, taken from the rear, top and right, of the snowshoe heel plate of the snowshoe of FIG. 1, with the heel lifter being in its operative position.

FIGS. 1 and 2 show a snowshoe 22 defining opposite top and bottom surfaces 22*a*, 22*b*, opposite front and rear ends 22*c*, 22*d*, opposite first and second sides 22*e*, 22*f*, a longitudinal axis 24 extending between front and read ends 22*c*, 22*d*, a transversal axis 26 extending between first and second sides 22; 22*f* and a vertical axis 28 extending between top and bottom surfaces 22*a*, 22*b*. Longitudinal, transversal and vertical axes 24, 26, 28 are mutually perpendicular. Longitudinal and transversal axes 24, 26 are in a common horizontal plane when snowshoe 22 lies horizontally, for example on the ground. It is noted that vertical axis 28 is in fact only vertical when snowshoe 22 lies horizontally on the ground although for simplicity's sake it will always be referred to as "vertical" within the present specification even if it may be otherwise inclined.

Snowshoe 22 comprises a rigid frame 30 that is shown to be a closed loop style frame, i.e. it includes front and rear segments 30*c*, 30*d* and first and second spaced-apart elongated side segments 30; 30*f* extending generally longitudinally along the snowshoe first and second sides 22; 22*f* respectively.

Snowshoe 22 also comprises a decking 32 carried by frame 30. More particularly, decking 32 is a flat sheet member that comprises several attachment tongues 34 that loop around frame 30 to be fixedly attached to the main decking portion with rivets 36. A V-shaped tensioning strap 38 also attaches decking 32 to the rear segment 30*d* of frame 30. Thus, decking 32 is suitably tensioned between the frame front and rear segments 30*c*, 30*d* and between the frame first and second side segments 30*e*, 30*f* that peripherally enclose decking 32. Decking 32 may be made from any suitable material, for example plastic, and is usually semi-rigid, which means that it may resiliently yieldingly deform during gait while the load of a person will reciprocatingly be applied to it then removed from it. Decking 32 comprises a toe hole 39, located about the intersection of longitudinal, transversal and vertical axes 24, 26, 28.

Figure 3:
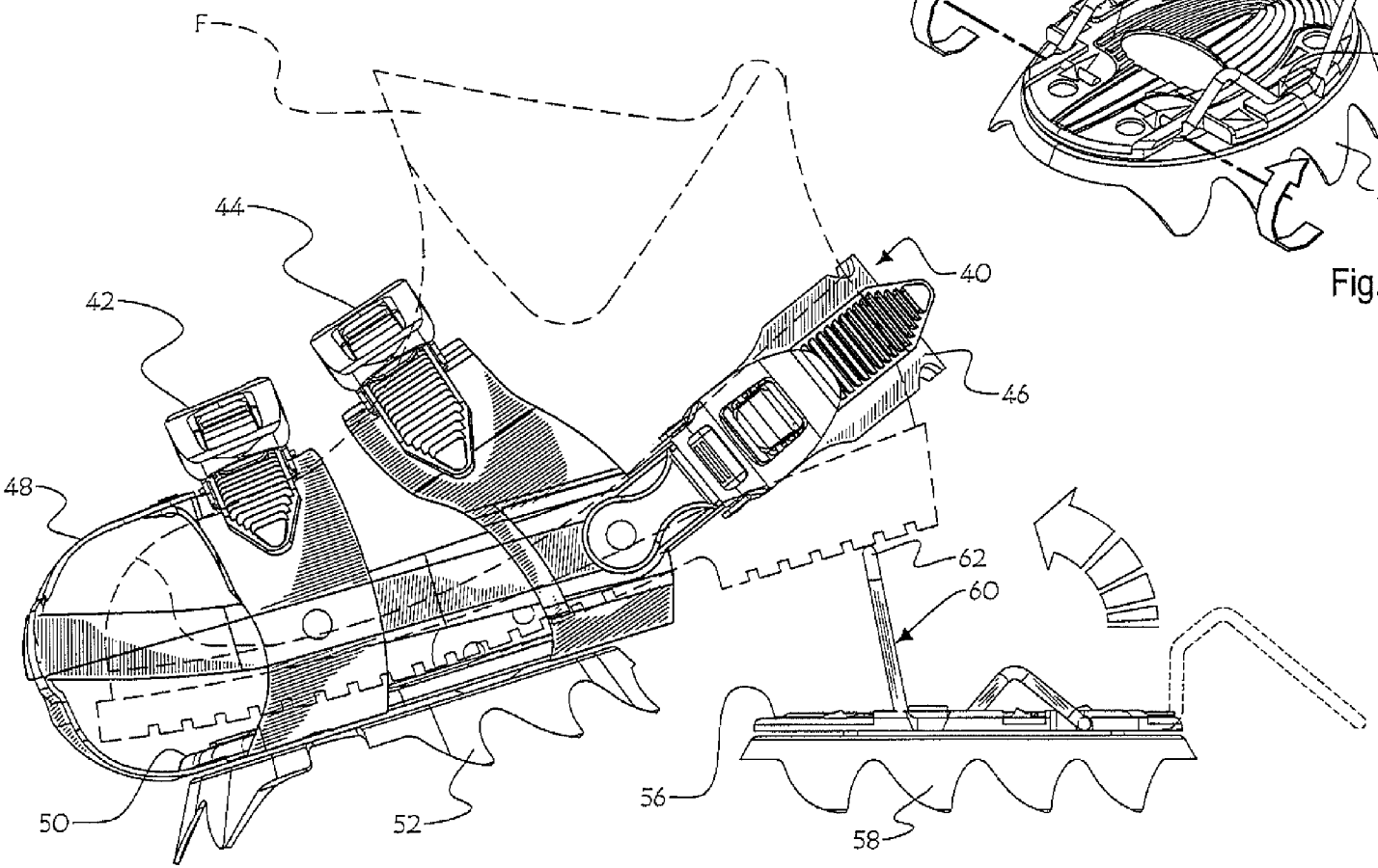
FIG. 3 is an enlarged partial side elevation showing the harness and heel plate with the harness pivoted away from its first limit position and with the heel lifter being shown in its operative position in full lines and its stowed position in dotted lines.

FIGS. 1-3 show that snowshoe 22 also comprises a harness 40 for releasable attachment of snowshoe 22 to a user's foot F. Harness 40 includes a pair of foot straps 42, 44, a heel strap 46 and a toe guard 48 all attached to a cradle 50 that can be more clearly seen in FIGS. 4-5. A toe cleat member 52 is attached underneath cradle 50. As will be detailed hereinafter, harness 40 is pivotally mounted to frame 30 by means of a pivot rod 64 that extends in toe hole 39 to form a hinge member 54. Harness 40 may thus lie in a first limit position shown in FIG. 1 in which it is generally parallel to decking 32 and in which heel strap 46 rests atop decking 32; and may be pivoted away from this first limit position as shown in FIGS. 2 and 3, in which case toe guard 48 will at least partly protrude through toe hole 39. In all positions of harness 40, toe cleat member 52 extends through toe hole 39 to be capable of engaging the ground in use.

FIGS. 1-3 and 6 show that snowshoe 22 comprises a heel plate 56 fixedly installed on decking 32 rearwardly of toe hole 39 on snowshoe top surface 20*a*. A heel cleat member 58 is fixedly installed underneath decking 32 in register with heel plate 56, i.e. on snowshoe bottom surface 20*b*. Decking 32 is consequently sandwiched between heel plate 56 and heel cleat member 58. A heel lifter 60 is pivotally attached between heel plate 56 and decking 32. Heel lifter 60 has one free heel-bearing extremity 62 that is pivotable between a stowed position shown in FIG. 1 and in dotted lines in FIG. 3 in which it lies against decking 32 rearwardly of heel plate 56; and an operative position shown in FIGS. 2 and 6 and in full lines in FIG. 3 in which it is pivoted spacedly over and above heel plate 56. A pair of resilient fingers 63 (FIG. 6) releasably retain heel lifter 60 in its operative position, otherwise heel lifter 60 is continuously biased towards its stowed position due to the intrinsic resiliency of heel plate 56 acting on heel lifter 60. Heel lifter 60 may manually be forced away from its stowed position against this resilient bias of heel plate 60. As shown in FIG. 3, heel lifter 60 is used in its operative position when snowshoe 22 is being used to climb uphill, in which case the user's heel may rest on heel lifter 60 for a more comfortable climbing position while the snowshoe itself will be inclined along the uphill ground line. In its stowed position, heel lifter 60 is not engaged by the user's foot F at all.

Figure 4:
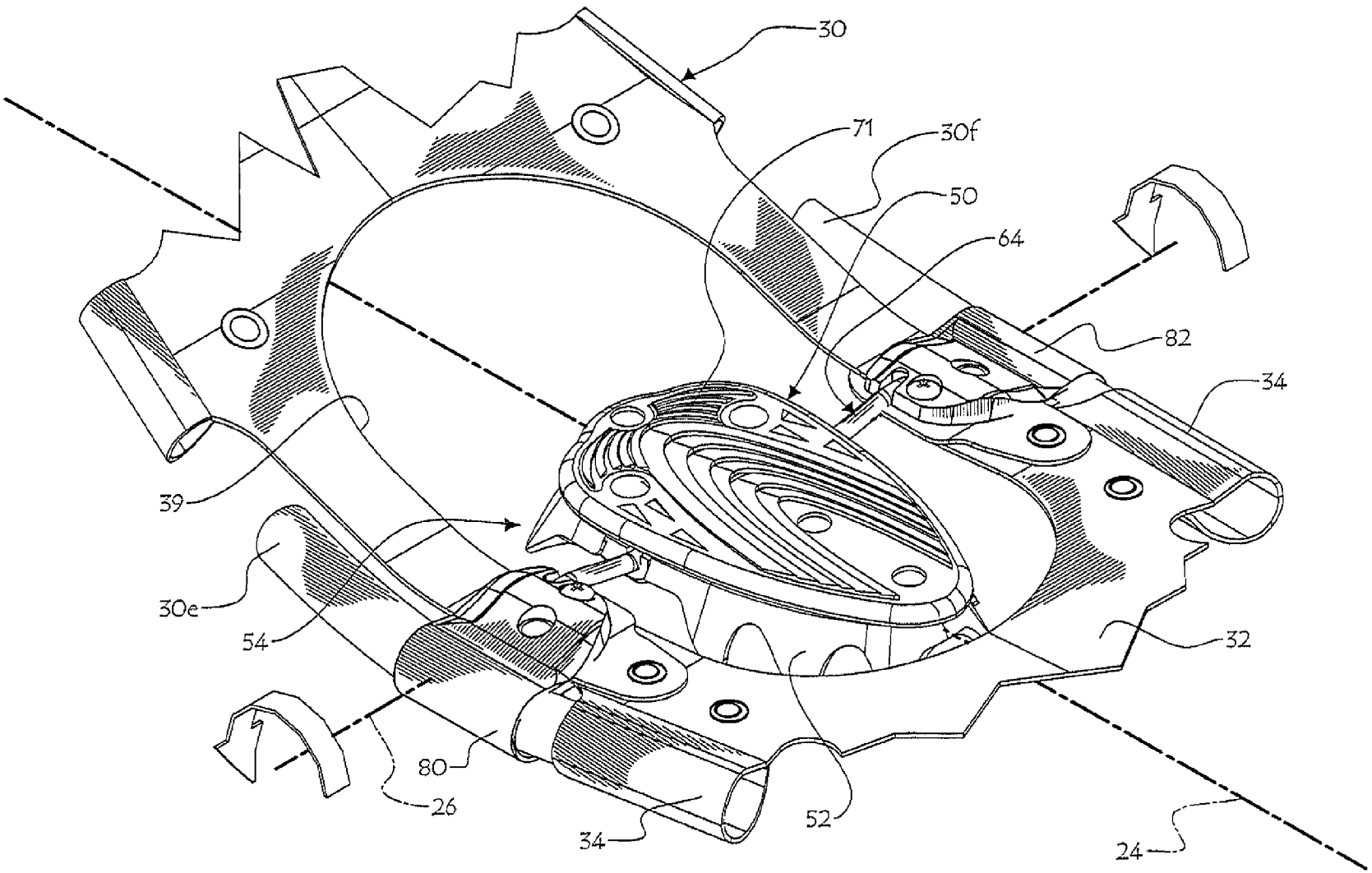
FIG. 4 is an enlarged partial perspective view of the snowshoe of FIG. 1, taken from the rear, top and left, showing more particularly the area of the frame and the decking near the toe hole and further showing the hinge member and the cradle of the harness.
Figure 7:
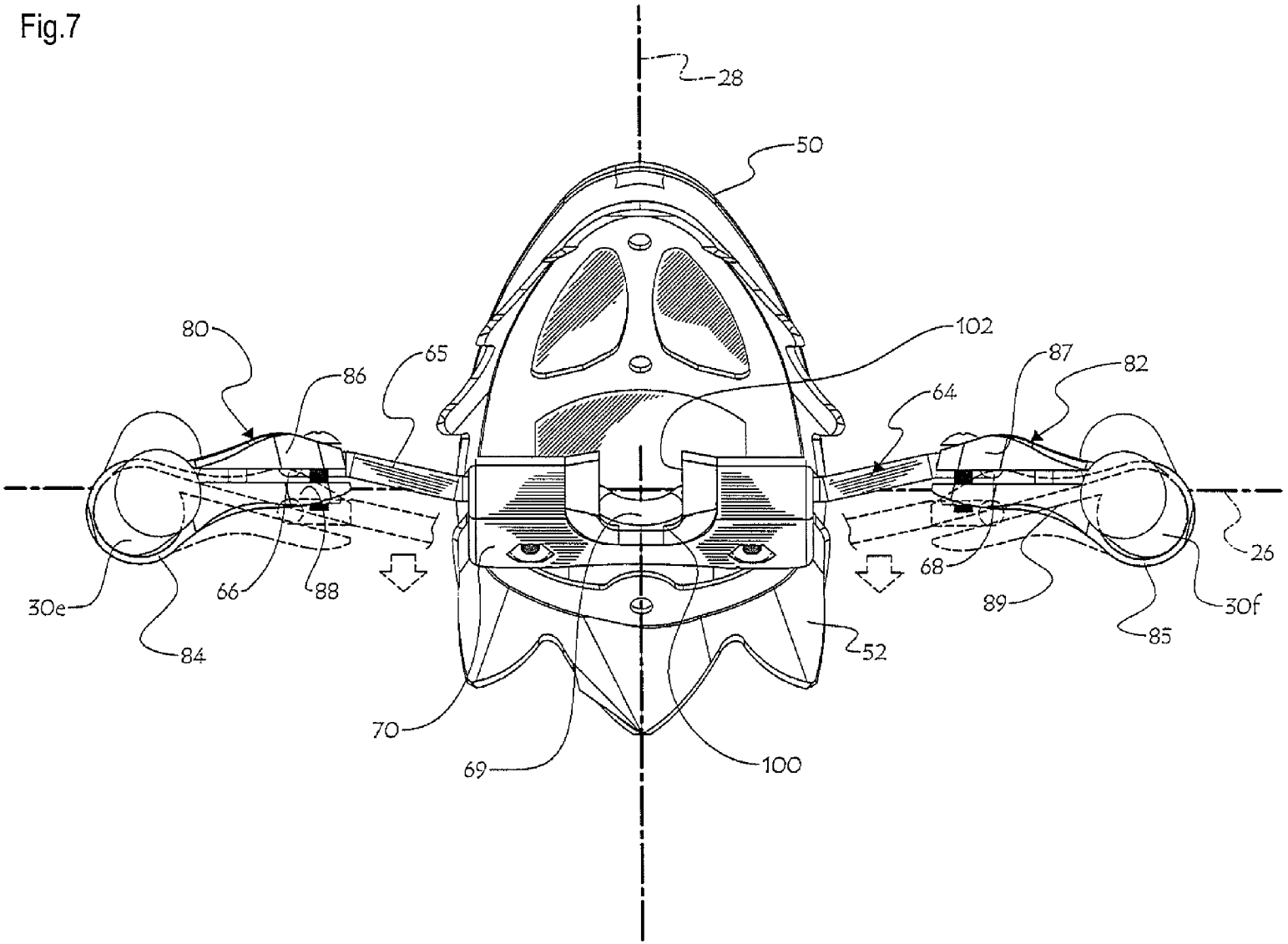
FIG. 7 is an enlarged rear elevation of the hinge member, harness cradle and frame side segments of the snowshoe of FIG. 1, with the cradle being pivoted away from its first limit position and with the pivotal amplitude of movement of the pivot rod and the pivot rod attachment mounts being suggested in dotted lines.

FIGS. 4, 5 and 7 show that snowshoe 22 comprises a rigid pivot rod 64 that can be made for example of metal. Pivot rod 64 extends generally parallel to transversal axis 26 and defines opposite first and second L-shaped end portions 64*e*, 64*f*. Pivot rod 64 comprises an intermediate segment 65 that is generally oriented parallel to transversal axis 26 and first and second end segments 66, 68 that are generally perpendicular to intermediate segment 65 and that are located at first and second end portions 64*e*, 64*f*. Intermediate segment 65 comprises a central bend forming a radially-protruding elbow 69. FIG. 7 shows that pivot rod intermediate segment 65 is generally arched towards the snowshoe bottom surface 20*b*. This provides a pre-tensioning to pivot rod 64 and helps prevent undesirable flexing thereof under load.

As mentioned above, harness 40 is pivotally mounted to pivot rod 64 to form hinge member 54. More particularly, cradle 50 pivotally rests on pivot rod 64 so as to be able to rock back and forth on top of pivot rod 64. Cradle 50 includes an attachment block 70 bolted underneath a main cradle plate 71, cradle block 70 having an elongated socket 72 oriented generally along transversal axis 26 wherein the central segment 65 of pivot rod 64 is partly enclosed. Toe cleat member 52 is sandwiched between attachment block 70 and the cradle plate 71 and is thus located above pivot rod 64.

Snowshoe 22 further comprises a first rigid rod attachment mount 80 pivotally mounted to frame first side segment 30*e* so as to be pivotable about first side segment 30*e*, i.e. about an axis that is generally parallel to longitudinal axis 24. Hinge member 54 also comprises a second rigid rod attachment mount 82 pivotally mounted to frame second side segment 30*f* so as to be pivotable about second side segment 30*f*, i.e. about an axis that is also generally parallel to longitudinal axis 24. As shown in FIGS. 5, 5*a* and 7, each rod attachment mount 80, 82 comprises a frame socket portion 84, 85 that slidingly engages the outer surface of its corresponding frame side segment 30*e*, 30*f*. Each rod attachment mount also comprises a top arm 86, 87 and a bottom arm 88, 89. The first rod attachment mount top and bottom arms 86, 88 sandwich a band of decking 32 that extends between toe hole 39 and frame first side segment 30*e*; while the second rod attachment mount top and bottom arms 87, 89 sandwich a band of decking 32 that extends between toe hole 39 and frame second side segment 30*f*. Arms 86, 88 are fixedly attached to each other and to their corresponding band of decking 32 and arms 87, 89 are fixedly attached to each other and to their corresponding band of decking 32.

Pivot rod first end portion 66 is pivotally mounted to first rod attachment mount 80 spacedly from frame first side segment 30*e* so as to allow pivot rod 64 to pivot about an axis that extends through pivot rod first end segment 66 and that is generally parallel to and spaced from frame first side segment 30*e*. More particularly, pivot rod first end portion 66 extends through a rod socket 91 (FIG. 5*a*) made in top arm 86 and is allowed to pivotally slide in rod socket 91 between top arm 86 and decking 32. Moreover, a recess 90 (FIGS. 5 and 5*a*) is made in top arm 86 in perpendicular connection with rod socket 91, to allow some freedom of movement to pivot rod intermediate segment 65 as pivot rod 64 pivots about its first end segment 66. More particularly, pivot arm intermediate segment 65 is allowed to pivot away from decking 32 and from bottom arm 88 through recess 90.

Pivot rod second end portion 68 is pivotally mounted to second rod attachment mount 82 spacedly from frame second side segment 30*f* so as to allow pivot rod 64 to pivot about an axis that extends through pivot rod second end segment 68 and that is generally parallel to and spaced from frame second side segment 30*f*. More particularly, pivot rod second end portion 68 extends through a rod socket (concealed in the figures but similar to rod socket 91) made in the top arm 87 of second rod attachment mount 82 and is allowed to pivotally slide in this rod socket between top arm 87 and decking 32. Moreover, a recess 92 (FIG. 5) is made in top arm 87 to allow some freedom of movement to pivot rod intermediate segment 65 as pivot rod 64 pivots about its second end segment 68. More particularly, pivot arm intermediate segment 65 is allowed to pivot away from decking 32 and from bottom arm 89 through recess 92.

The rigid pivot rod 64 and rigid first and second rod attachment mounts 80, 82 thus cooperate to maintain first and second frame side segments 30*e*, 30*f* spaced apart with respect to one another. Indeed, with no flexible pieces but only rigid pieces extending between the frame side segments along hinge member 54, hinge member 54 will help prevent the frame side segments from collapsing towards one another under load thus effectively providing an enhanced rigidity to snowshoe 22. This is highly desirable as it allows use of a lighter frame 30 which significantly decreases the overall weight of snowshoe 22.

Also, the rigid link between harness 40 and frame 30 through rigid pivot rod 64 and rigid first and second rod attachment mounts 80, 82 offers a greater lateral control of snowshoe 22 to the user. Indeed, when turning or sidestepping, the user will apply sideward pressure on harness 40 and the latter will transmit this sideward pressure directly to snowshoe 22 through the above-mentioned rigid link.

Furthermore, with harness 40 being attached to pivot rod 64, some freedom of movement is still allowed for harness 40 in addition to the rocking movement thereof over pivot rod 64. Indeed, as suggested in FIG. 7, pivot rod 64 and consequently harness 40 are allowed to move linearly along vertical axis 28, for example when pivot rod 64 is reciprocatingly loaded and unloaded during gait. To allow this linear vertical displacement of pivot rod 64, two pivotal movements will simultaneously occur:

1) first and second rod attachment mounts 80, 82 will both pivot about their respective first and second frame side segments 30*e*, 30*f*; and 2) the pivot rod first and second end segments 66, 68 will both pivot relative to their respective first and second rod attachment mounts 80, 82.

More particularly, from a rest position shown in full lines in FIG. 7, pivot rod 64 will be allowed to move vertically downwardly towards a lower position if forced downwardly under load: arms 86, 88 and 87, 89 will indeed then be pivoted downwardly as shown in dotted lines. The bands of decking 32 that are attached to arms 86, 88 and 87, 89 between toe hole 39 and frame side segments 30*e*, 30*f* will resiliently yieldingly deform to allow this pivotal movement of rod attachment mounts 80, 82. Pivot rod intermediate segment 65, while it moves linearly downwardly, will concurrently move relatively away from decking 32 partly into recesses 90, 92 to allow the pivotal movement of rod attachment mounts 80, 82.

Naturally, the movement of pivot rod 64 back from this lower position to its rest position is also allowed. In fact, the resilient decking 32 will continuously bias pivot rod 64 towards its rest position when it is not in its rest position, by acting on rod attachment mounts 80, 82 to which it is attached.

The linear vertical displacement of pivot rod 64 effectively provides hinge member 54 with a suspension effect, i.e. when frame 30 and decking 32 engage the snow on the ground during gait, the foot will gradually move pivot rod 64 downward effectively dampening the down stroke of the step.

It is noted that the bands of decking 32 that extend on either side of toe hole 39, together with the non-recessed bottom arms 88, 89 of the first and second attachment mounts 80, 82, will desirably limit the pivotal movement of pivot rod 64 relative to first and second attachment mounts 80, 82 to a downward movement only from its rest position. Indeed, in the rest position of pivot rod 64 shown in FIG. 7 in full lines, pivot rod intermediate segment 65 abuts against decking 32 and the latter is supported by bottom arms 88, 89. Consequently, as the snowshoe is lifted during gait, there will no unnecessary upward movement of pivot rod intermediate segment 65 away from its rest position even if the weight of snowshoe 22 and snow resting on it would apply pressure in this respect. Indeed, for pivot rod intermediate segment 65 to move linearly upwardly, arms 86, 88 of first rod attachment mount 80 and arms 87, 89 of second rod attachment mount 82 would have to pivot upwardly which is prevented by the abutment of rod intermediate segment 65 against decking 32 which is supported by bottom arms 88, 89. So while the movement of pivot rod 64 is allowed in a downward direction due to the engagement of rod intermediate segment 65 into recesses 90, 92, it is prevented in an upward direction due to the underlying decking 32 and bottom arms 88, 89.

Additionally to its allowed linear vertical movement, pivot rod 64 is also allowed to pivot or roll about an axis that is generally parallel to longitudinal axis 24. More particularly, if downward pressure is applied on pivot rod 64 on one side more than on the other, than pivot rod 64 may pivot asymmetrically relative to vertical axis 28 about longitudinal axis 24. That is to say, one rod attachment mount 80 or 82 may pivot downwardly while the other will not pivot or will pivot to a lesser degree. This further enhances the suspension effect that helps dampen shocks of the foot down stroke, while also allowing the user's foot to adopt a horizontal position or a position closer to a horizontal plane even though the snowshoe itself is inclined laterally.

The combined vertical linear displacement and roll of the pivot rod 64/harness 40 assembly consequently provides snowshoe 22 with a very advantageous suspension effect. In prior art snowshoes, a rigid pivot rod extending between the frame side segments to enhance the rigidity of the snowshoe usually meant less freedom of movement for the harness and no suspension. In the present invention however, the advantageous combination of the rigid pivot rod with the pivoting rigid rod attachment mounts allows to have both rigidity in the snowshoe 22 and some freedom of movement for the harness 40 for linear vertical displacement and roll.

Figure 8:
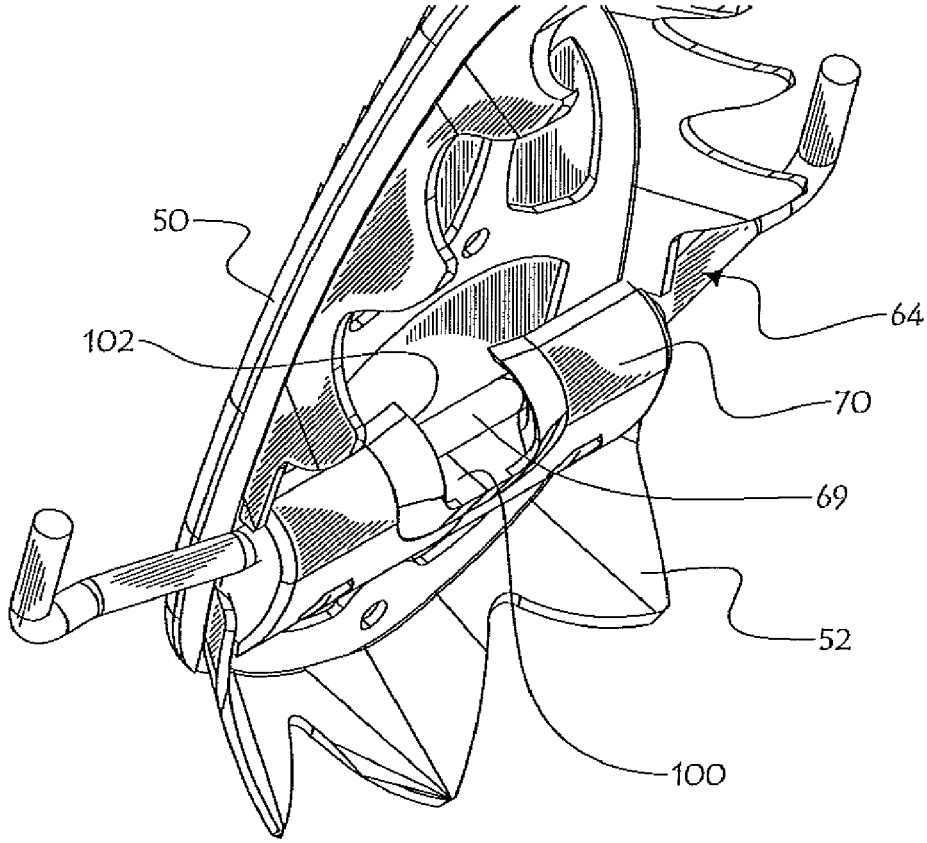
FIG. 8 is an enlarged perspective view, taken from the rear and the left, of the pivot rod and the cradle, with the pivot rod being in its first limit position.
Figure 9:
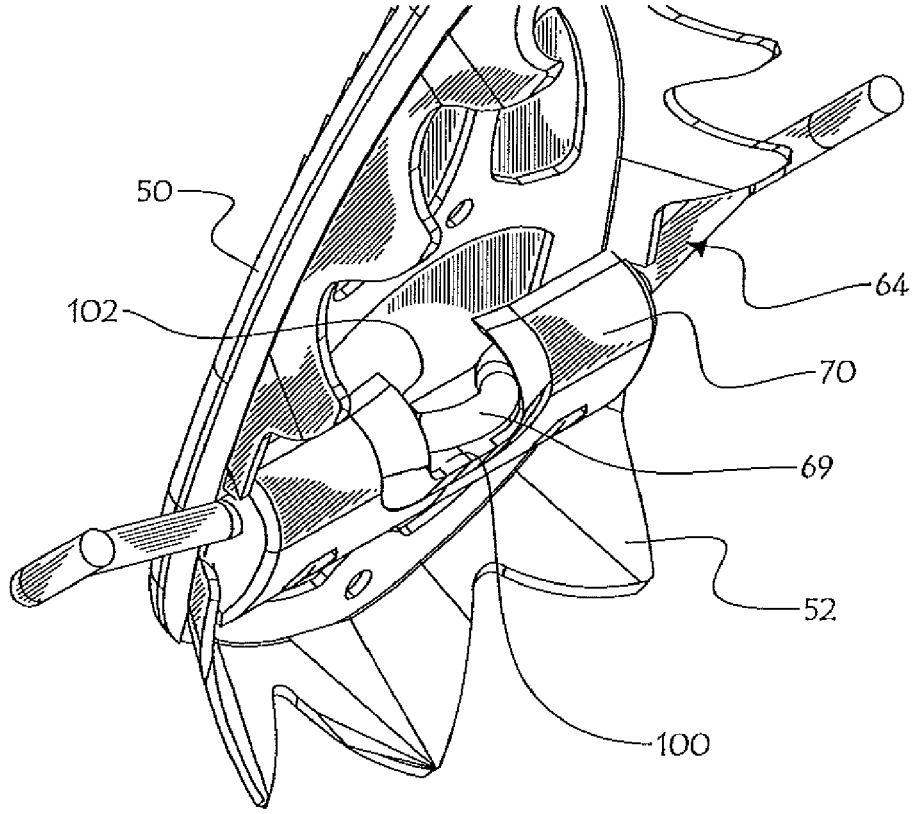
FIG. 9 is a view similar to FIG. 8 but with the cradle in its second limit position.

According to the present invention, snowshoe 22 also comprises means for limiting the pivotal movement of cradle 50 and thus of harness 40 about pivot rod 64 within a determined angular range. FIGS. 5, 7 and 8 show that the means for limiting the pivotal movement of cradle 50 comprise a first pivot limiter in the form of elbow 69 provided on pivot rod 64 and a second pivot limiter in the form of an abutment shoulder 100 formed in an opening 102 made in the cradle attachment block 70. The first and second pivot limiters 69, 100 are complementary in that they can interact with each other to limit the pivotal displacement of pivot cradle 50 and consequently of the entire harness 40 to a determined angular range. Indeed, harness 40 may consequently pivot between a first limit position shown in FIGS. 1, 4 and 8 in which it is pivoted back against the upper surface of decking 32 with the heel strap 46 abutting against decking 32; through intermediate positions such as the ones shown in FIGS. 2 and 7 wherein the harness toe guard is pivoted partly into toe hole 39; and into a second limit position shown in FIG. 9 wherein the cradle abutment shoulder 100 abuts against the pivot rod elbow 69 to prevent cradle 50 from pivoting further into toe hole 39.

In use, the harness pivotal limiting means will allow pivotal displacement of the harness within a normal operational angular range, i.e. when walking or running the human foot normally pivots within a certain angular range and the pivotal limiting means do not prevent that. However, the pivotal limiting means will prevent the harness from pivoting beyond a certain determined angular threshold value, for example 70° away from the harness's first limit position (although it is understood that any desired angular value other than 70° can be selected by the manufacturer). This angular threshold value will help lift the snowshoe tail or rear end 22*d*, for example to step over ground obstacles. Indeed, when raising his foot high over ground to step over obstacles, the user may adopt positions of his foot in which his toes point in varying directions including downwards. If the harness 40 was allowed a full pivotal movement about pivot rod 64, then the snowshoe rear end 22*d* could pivot downwards and become a hindrance to step over an obstacle even in awkward foot positions. Instead, the pivotal limiting means will block the pivotal movement of the snowshoe frame and decking relative to the user's foot, thereby allowing the user to control the position of the snowshoe rear end 22*d* as he steps over the obstacle. Also, the pivotal limiter will prevent the snowshoe front end 22*c* from undesirably contacting the user's shinbone when the snowshoe is lifted over ground.

Figure 10:
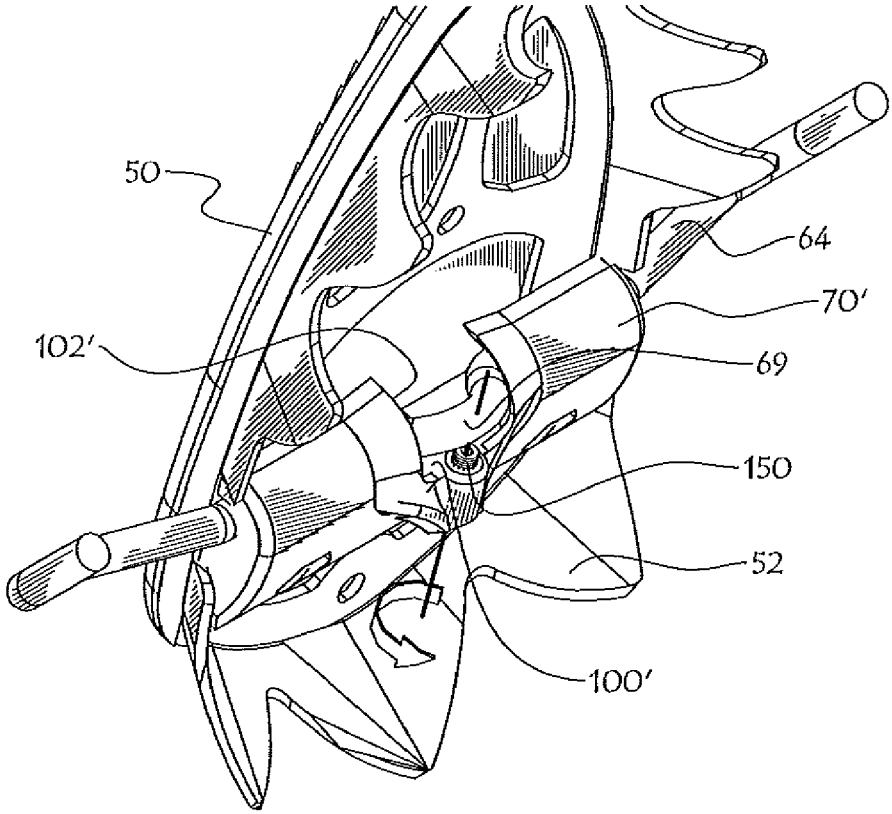
FIGS. 10 and 11 are enlarged perspective views, taken from the rear and the left, of the pivot rod and the cradle, with the pivot rod being pivoted away from its first limit position, FIGS. 10 and 11 showing respective alternate embodiment of cradle pivotal limiters.

According to one alternate embodiment of the present invention, there are also provided means for selectively adjusting the value of the determined angular range of the pivotal movement of the harness. More particularly, snowshoe 22 comprises means for adjusting the position of the cradle's abutment shoulder whereby the value of the determined angular range of the pivotal movement of the harness may be selectively adjusted. In one embodiment shown in FIG. 10, the means for adjusting the position of the cradle's abutment shoulder include an adjustment screw 150 threadingly engaging the cradle attachment block 70' which is similar to cradle attachment block 70 except that it is adapted to receive adjustment screw 150. In this embodiment, the abutment shoulder on which pivot rod elbow 69 will abut in the second limit position of harness 40 can be either one of the abutment surface 100' made in the attachment block opening 102' or screw 150, depending on the position of adjustment screw 150: if screw 150 does not protrude into opening 102', then the harness may pivot until abutment surface 100' abuts against pivot rod elbow 69; however, if adjustment screw 150 is adjusted to have it protrude into opening 102', then the harness will be limited in its second limit position by the abutment of screw 150 against pivot rod elbow 69. It can consequently be seen that the more screw 150 is adjusted to protrude within opening 102', the less harness 40 will be allowed to pivot away from its first limit position.

Figure 11:
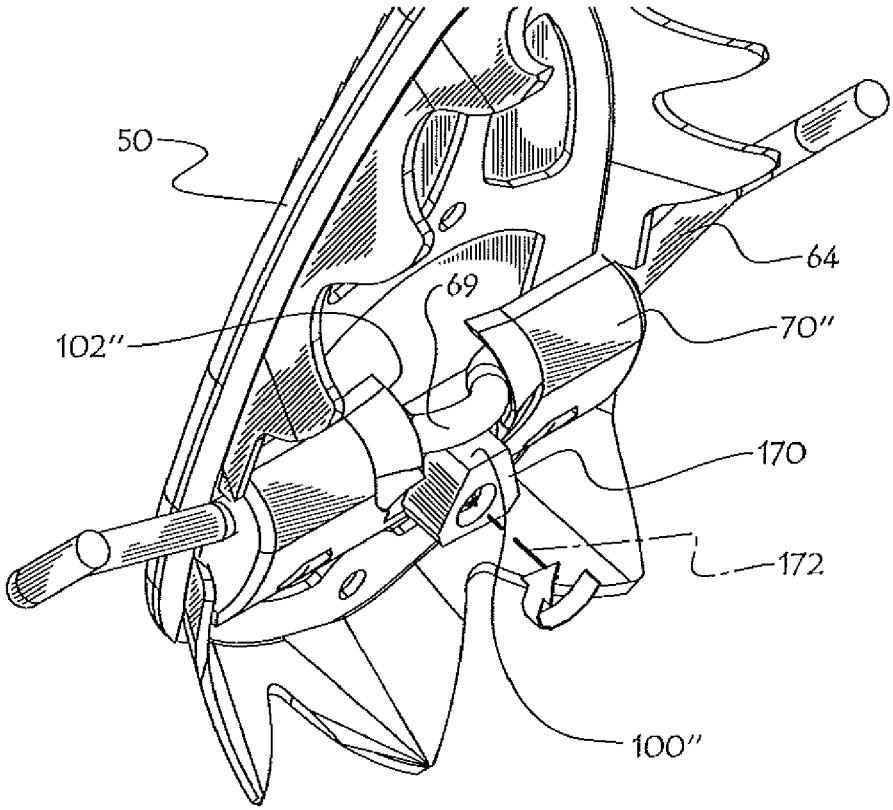

In another embodiment shown in FIG. 11, the means for adjusting the position of the cradle's abutment shoulder include a shoulder nut 170 rotatably mounted to cradle support block 70" that is similar to cradle support block 70 except that it is adapted to carry shoulder nut 170. Shoulder nut 170 carries is rotatably mounted to cradle support block 70" and is asymmetrical relative to its rotational axis 172: indeed, it comprises several abutment shoulder surfaces that are each spaced apart with respect to the nut rotational axis 172, one of which 100" will be selected to face the support block opening 102" and be engaged by pivot rod elbow 69 in its second limit position. By rotating shoulder nut 170, the user can select one abutment shoulder surface that will allow more or less pivotal displacement to elbow 69 in its second limit position.

In all embodiments, one advantageous aspect of the pivotal limiters of the present invention resides in the disposition thereof relative to cradle 50. More particularly, the cradle attachment block opening 102, 102', 102", the cradle attachment block abutment shoulder 100, 100', 100" and the pivot rod elbow 69 are all located underneath cradle plate 71. This is advantageous in that snow and ice will not be directed or compacted into opening 102, 102', 102" by the user's foot which could hinder the pivotal movement of harness 40 under normal operation during gait. Moreover, opening 102, 102', 102" has a generally opened configuration, i.e. it is not a narrow slot having two proximate end walls wherein snow and ice could more easily clog the mechanism, Finally, as cradle 50 rocks back and forth during gait, elbow 69 will move in opening 102, 102', 102" to clear any snow and ice that might accidentally find its way therein.

More generally, the position of pivot rod 64 with respect to cradle 50 is also advantageous. Indeed, having the pivot rod 64 located underneath cradle 50 helps prevent snow and ice from clogging the socket 72 that slides around pivot rod 64. Not only that, but socket 72 in fact encloses pivot rod 64 along most of the width of cradle 50; only at opening 102, 102', 102" is access to pivot rod 64 and socket 72 allowed. This minimizes access of snow and ice into socket 72 and importantly helps prevent the pivotal movement of cradle 50 from being hindered.

It is noted that elbow 69 also serves another purpose in addition to cooperating with so cradle support block 70, 70', 70" to act as a pivotal limiter: by protruding within opening 102, 102' 102" it also prevents cradle 50 from moving transversely along pivot rod 64.

Although the present description and drawings show that harness 50 is pivotally mounted to pivot rod 64, an alternate embodiment of the invention (not shown) could comprise a harness fixedly attached to the pivot rod with the latter being pivotally mounted to the rod attachment mounts so as to be pivotable generally about an axis which is generally parallel to the snowshoe transversal axis. This could be achieved without sacrificing the additional pivotal relationship between the pivot rod and the rod attachment mounts about an axis which is generally parallel to the frame side segments for example by using a universal joint such as a ball joint or the like. Other minor modifications to the design of the hinge member could then be envisioned, notably as they relate to the pivotal limiter that would then need to be designed differently.

Within the present description and claims, it is mentioned that some elements extend along or generally along the direction of the longitudinal, transversal or vertical axes of the snowshoe, or along or generally along one or another structure of the snowshoe such as its side segments. It should be noted that some reasonable degree of deviation with respect to these directions is considered acceptable, so for example the pivotal engagement of the pivot rod end segments 66, 68 within rod attachment mounts 80, 82 could in fact occur about respective axes that are not quite parallel to frame side segments 30*e*, 30*f* or parallel to one another without deviating from the scope of the present invention. Also, it is understood that frame side segments 30; 30*f* and pivot rod intermediate segment 65 are not straight, so reference to their general alignment with respect to other strictures or to axes is made to provide a general idea of its orientation or movement.

It is noted that although frame 30 was shown to be of the closed loop type having a rear segment 30*d*, it could alternately be of the opened loop type lacking a rear segment 30*d*.

The invention claimed is:

1. A hinge member for mounting a harness to a frame of a snowshoe, comprising:

a rigid pivot rod for extending between frame first and second side segments and comprising opposite first and second end portions, said pivot rod for pivotally mounting the harness relative to the frame;

a first rigid rod attachment mount having a first frame socket for pivotal attachment to the frame first side segment so as to be pivotable about the frame first side segment, and a first rod socket wherein said rigid pivot rod first end portion is pivotally mounted, said first rod socket being spaced apart from said first frame socket so as to allow said pivot rod to pivot about an axis which is generally parallel to and spaced from said first frame socket; and a second rigid rod attachment mount having a second frame socket for pivotal attachment to the frame second side segment so as to be pivotable about the frame second side segment, and a second rod socket wherein said rigid pivot rod second end portion is pivotally mounted, said second rod socket being spaced apart from said second frame socket so as to allow said pivot rod to pivot about an axis which is generally parallel to and spaced from said second frame socket.

2. A snowshoe defining opposite top and bottom surfaces, opposite front and rear ends, opposite first and second sides, a longitudinal axis between said front and read ends, a transversal axis between said first and second sides and a vertical axis between said top and bottom surfaces, said snowshoe comprising:

a rigid frame defining first and second spaced-apart elongated side segments extending generally longitudinally along said snowshoe first and second sides, and a front segment linking said first and second side segments at said snowshoe front end;

a decking carried by said frame between said first and second side segments;

a rigid pivot rod extending generally parallel to said transversal axis and comprising opposite first and second end portions;

a harness for releasable attachment to a user's foot, said harness being pivotally mounted relative to said frame by means of said pivot rod so as to be pivotable generally about an axis which is generally parallel to said transversal axis;

a first rigid rod attachment mount comprising a first frame socket pivotally mounted to said frame first side segment so as to be pivotable about said frame first side segment, and a first rod socket within which said rigid pivot rod first end portion is pivotally mounted, with said first frame socket being spaced apart from said first rod socket so as to allow said pivot rod to pivot about an axis which is generally parallel to and spaced from said frame first side segment; and a second rigid rod attachment mount comprising a second frame socket pivotally mounted to said frame second side segment so as to be pivotable about said frame second side segment, and a second rod socket within which said rigid pivot rod second end portion is pivotally mounted, with said second frame socket being spaced apart from said second rod socket so as to allow said pivot rod to pivot about an axis which is generally parallel to and spaced from said frame second side segment;

wherein said rigid pivot rod and rigid first and second rod attachment mounts cooperate to maintain said first and second frame side segments spaced apart with respect to one another for providing an enhanced rigidity to said snowshoe while allowing said harness to move along said vertical axis and to roll generally about said longitudinal axis for providing a suspension effect to said snowshoe.

3. A snowshoe as defined in claim 2, wherein said harness comprises a cradle for receiving the user's foot, said cradle pivotally engaging said pivot rod, said cradle comprising an elongated cradle socket for said pivot rod in which said pivot rod is partly enclosed by said cradle.

4. A snowshoe as defined in claim 3, wherein said cradle comprises a cradle plate which is located over said pivot rod along said vertical axis.

5. A snowshoe as defined in claim 2, wherein said first and second rigid rod attachment mounts are further attached to said decking.

6. A snowshoe as defined in claim 2, wherein said pivot rod has a rest position and said snowshoe defines biasing means that continuously force said pivot rod towards said rest position along said vertical axis.

7. A snowshoe as defined in claim 6, wherein said pivot rod is allowed to move vertically down and away from said rest position along said vertical axis, but not up and away from said rest position.

8. A snowshoe as defined in claim 2, wherein said pivot rod is arched towards said bottom surface of said snowshoe.

9. A snowshoe as defined in claim 2, wherein said snowshoe comprises means for limiting the pivotal movement of said harness about said rod within a determined angular range.

10. A snowshoe as defined in claim 9, further comprising means for selectively adjusting the value of said determined angular range.

11. A snowshoe as defined in claim 2, wherein said harness comprises a cradle for receiving the user's foot and pivotally engaging said pivot rod, said pivot rod comprising a first pivot limiter and said cradle comprising a second pivot limiter complementary to said first pivot limiter whereby said first and second pivot limiter can engage one another to allow the pivotal displacement of said cradle about said pivot rod to be limited to a determined angular range.

12. A snowshoe as defined in claim 11, wherein said first pivot limiter is an elbow extending radially away from said pivot rod and said second pivot limiter is an abutment shoulder formed in said cradle whereby said cradle may not pivot beyond a position where said elbow abuts against said abutment shoulder.

13. A snowshoe as defined in claim 12, further comprising means for adjusting the position of said abutment shoulder whereby the value of said determined angular range may be selectively adjusted.

14. A snowshoe as defined in claim 13, wherein said means for adjusting the position of said abutment shoulder include an adjustment screw threadingly engaging said cradle with one end of said screw capable of acting as said abutment shoulder, said screw being selectively movable to allow adjustment of the position of said abutment shoulder.

15. A snowshoe as defined in claim 13, wherein said means for adjusting the position of said abutment shoulder include a shoulder support mounted to said cradle and carrying at least two different shoulder pads each corresponding to different limit angular values of said determined angular range.

16. A snowshoe as defined in claim 12, wherein said elbow further engages said cradle to prevent said cradle from moving in a direction generally parallel to said transversal axis along said pivot rod.

17. A snowshoe as defined in claim 2, wherein said frame further comprises a rear segment linking said first and second side segments at said rear end of said snowshoe, whereby said frame peripherally encloses said decking.

* * * * *